US009943864B2

(12) United States Patent
Mitsui et al.

(10) Patent No.: US 9,943,864 B2
(45) Date of Patent: Apr. 17, 2018

(54) ELECTROSTATIC COATER

(71) Applicant: Ransburg Industrial Finishing K.K., Yokohama-shi (JP)

(72) Inventors: Michio Mitsui, Yokohama (JP); Osamu Yoshida, Yokohama (JP); Yoshiji Yokomizo, Yokohama (JP)

(73) Assignee: RANSBURG INDUSTRIAL FINISHING K.K., Kanagawa (JP)

( * ) Notice: Subject to any disclaimer, the term of this patent is extended or adjusted under 35 U.S.C. 154(b) by 0 days.

(21) Appl. No.: 15/035,087

(22) PCT Filed: Oct. 29, 2014

(86) PCT No.: PCT/JP2014/078763
§ 371 (c)(1),
(2) Date: May 6, 2016

(87) PCT Pub. No.: WO2015/068626
PCT Pub. Date: May 14, 2015

(65) Prior Publication Data

US 2016/0271630 A1 Sep. 22, 2016

(30) Foreign Application Priority Data

Nov. 8, 2013 (JP) ..... 2013-231799

(51) Int. Cl.
*B05B 3/10* (2006.01)
*B05B 5/03* (2006.01)
*B05B 5/04* (2006.01)

(52) U.S. Cl.
CPC ..... *B05B 5/03* (2013.01); *B05B 5/0407* (2013.01); *B05B 5/0426* (2013.01); *B05B 3/1092* (2013.01)

(58) Field of Classification Search
CPC ..... B05B 3/10; B05B 3/1007; B05B 3/1014; B05B 3/1092; B05B 5/03; B05B 5/04; B05B 5/0403; B05B 5/0407; B05B 5/0426
See application file for complete search history.

(56) References Cited

U.S. PATENT DOCUMENTS 6,050,499 A * 4/2000 Takayama ..... B05B 15/025 239/105
7,611,069 B2 * 11/2009 Clifford ..... B05B 3/1092 239/222.11

(Continued)

FOREIGN PATENT DOCUMENTS

EP 2058053 A1 5/2009
EP 2614895 A1 7/2013

(Continued)

OTHER PUBLICATIONS

Translation of Japanese International Search Report for PCT Application No. PCT/JP2014/078763 dated Jan. 13, 2015, 2 pages.

(Continued)

*Primary Examiner* — Darren W Gorman
(74) *Attorney, Agent, or Firm* — Fletcher Yoder, P .C.

(57) ABSTRACT

An electrostatic coater capable of realizing high-level coating quality is provided. Shaping air SA, discharged from an air port, is directed radially outward. An elevation angle thereof preferably ranges from 10 to 20 degrees. Further, the shaping air SA is a flow in a state of being twisted in a direction opposite to the rotation direction R of a bell cup. The twisting angle about the axis O of the bell cup preferably ranges from 38 to 60 degrees. A liquid thread of paint extends radially outward from the outer peripheral edge of the bell cup, and the paint separated from the tip end thereof becomes a particle. It is preferable that the shaping air SA (Continued)

collides with the paint particle at a point P where the momentum of the paint particle is decreased of the paint particle is decreased.

5 Claims, 10 Drawing Sheets

(56) References Cited

U.S. PATENT DOCUMENTS

| | | | | |
|---|---|---|---|---|
| 2003/0010840 | A1* | 1/2003 | Kon | B05B 3/1014 239/223 |
| 2007/0262170 | A1* | 11/2007 | Nolte | B05B 5/001 239/291 |
| 2009/0220703 | A1* | 9/2009 | Wohr | B05B 3/1014 427/475 |
| 2010/0192848 | A1* | 8/2010 | Ballu | B05B 3/1092 118/323 |
| 2011/0014387 | A1 | 1/2011 | Mitsui et al. | |
| 2011/0210180 | A1* | 9/2011 | Perinet | B05B 3/1092 239/1 |
| 2015/0110964 | A1* | 4/2015 | Prus | B05B 5/0426 427/427.3 |

FOREIGN PATENT DOCUMENTS

| | | | |
|---|---|---|---|
| GB | 2294214 | A | 4/1996 |
| JP | H03-101858 | A | 4/1991 |
| JP | H07-265746 | A | 10/1995 |
| JP | H08-084941 | A | 4/1996 |
| JP | H08-131902 | A | 5/1996 |
| JP | H09-094488 | A | 4/1997 |
| JP | 2000-070769 | A | 3/2000 |
| JP | 2007-260490 | A | 10/2007 |
| JP | 2008-093521 | A | 4/2008 |
| JP | 2008-093533 | A | 4/2008 |
| JP | 2009-214065 | A | 9/2009 |
| JP | 2012115736 | A | 6/2012 |
| JP | 2013166113 | A | 8/2013 |

OTHER PUBLICATIONS

Extended European Search Report for EP Application No. 14860737.7 dated Mar. 30, 2017, 7 pgs.

* cited by examiner

ELECTROSTATIC COATER

CROSS REFERENCE TO RELATED APPLICATIONS

This application claims priority to and benefit of PCT Application No. PCT/JP2014/078763, entitled "ELECTROSTATIC COATER," filed Oct. 29, 2014, which claims priority to and benefit of Japanese Patent Application No. 2013-231799, entitled "ELECTROSTATIC COATER," filed Nov. 8, 2013, each of which is hereby incorporated by reference in its entirety.

BACKGROUND OF THE INVENTION

Technical Field

The present invention relates to an electrostatic coating technology, and in more detail, to an electrostatic coater having a rotary atomizing head.

Background Art

It is a well-known fact that electrostatic coaters are widely used. Electrostatic coaters are frequently used in the automobile industry. In the automobile industry, as the coating quality affects the commercial value of an automobile, each manufacturer sets a rigid standard for the coating quality. As such, electrostatic coaters keep evolving in response to strict demands from the automobile industry.

Paint used for coating an automobile includes a solid paint, a clear paint, and a metallic paint. As a metallic paint, there is a so-called pearl paint containing nonmetallic glossy chips such as mica, besides a paint including metallic chips.

As for electrostatic coating using a metallic paint, it is difficult to realize high-level coating quality. Specifically, with a metallic paint, it is known that if a colliding speed of the paint with an automobile body (hereinafter referred to as a "workpiece"), which is an object to be coated, is slow, the finished appearance of the workpiece is dark. It is also known that as the diameter of a paint particle is larger, the finished appearance of the workpiece becomes darker. In order to realize metallic coating having high-level coating quality, a large number of proposals have been made.

An electrostatic coater of a rotary atomization type, disclosed in Patent Literature 1, includes two systems of air ports arranged coaxially with a rotary atomizing head. Air ports of a first system are positioned on a relatively inner peripheral side. Air ports of a second system are positioned on a relatively outer peripheral side. The orientation of the first air ports on the inner peripheral side is parallel to the axis of the rotary atomizing head. The inner shaping air discharged from the first air ports passes through the vicinity of the outer peripheral edge of the rotary atomizing head. The inner shaping air has a higher pressure and a lower flow rate than those of the outer shaping air discharged from the air ports of the second system. By the inner shaping air, atomization of the paint is facilitated. Then, the atomized paint is accelerated toward the workpiece by the outer shaping air, having a lower pressure and a higher flow rate relatively, discharged from the second air ports.

Patent Literature 2 proposes an electrostatic coating method which improves the coating quality and the coating efficiency of a metallic paint. An electrostatic coater of a rotary atomization type to be used in this electrostatic coating method includes one system of air ports. The orientation of the air ports is parallel to the axis of the rotary atomizing head. The shaping air discharged from the air ports passes through the vicinity of the outer peripheral edge of the rotary atomizing head. Patent Literature 2 proposes to control the peripheral velocity of the rotary atomizing head of the coater.

Patent Literature 3 proposes an electrostatic coater of a rotary atomization type capable of improving the coating quality of metallic coating. The electrostatic coater includes a plurality of air ports arranged behind a rotary atomizing head concentrically with the axis of the rotary atomizing head, and shaping air is discharged from the plurality of air ports. The orientation of the air ports, when the coater is viewed laterally, is parallel to the axis of the rotary atomizing head. When the coater is viewed from the front, the air ports are positioned 2 to 3 mm outward from the outer peripheral edge of the rotary atomizing head. The air ports include guide grooves on the tip end side. The shaping air discharged from each of the air ports becomes a jet flow in a state of being twisted in a rotation direction of the rotary atomizing head or a direction opposite thereto, by the guide groove. This means that the shaping air becomes a flow in a state close to a swirling flow, not to say a swirling flow itself. By setting the twisting direction of the shaping air to a direction opposite to the rotation direction of the rotary atomizing head, it is possible to cause the shaping air to strongly collide with the charged paint particles being scattered from the outer peripheral edge of the rotary atomizing head. Thereby, the paint particles can be micronized.

Patent Literature 4 proposes an electrostatic coater of a rotary atomization type by which metallic coating and general coating can be performed with a single coater. That is, Patent Literature 4 proposes a coater which does not deteriorate both the coating quality of metallic coating and the coating quality of general coating using a solid paint or a clear paint other than a metallic paint. The coater disclosed in Patent Literature 4 includes air ports arranged behind a rotary atomizing head, on first and second circumferences coaxial with the rotary atomizing head. A plurality of first air ports arranged on the first circumference of the inner peripheral side discharge first shaping air toward the rear surface of the rotary atomizing head. Second air ports arranged on the second circumference of the outer peripheral side discharge second shaping air toward the outer peripheral edge of the rotary atomizing head.

The orientation of both the first and second air ports is parallel to the axis of the rotary atomizing head when the coater is viewed laterally. The first shaping air directed to the rear surface of the rotary atomizing head is a straight flow. On the other hand, the second shaping air directed to the outer peripheral edge of the rotary atomizing head is a jet flow in a state of being twisted about the axis of the rotary atomizing head. It should be noted that Patent Literature 4 fails to clearly describe whether the second shaping air is twisted in a rotation direction of the rotary atomizing head or in a direction opposite to the rotation direction of the rotary atomizing head.

The first shaping air directed to the rear surface of the rotary atomizing head is used for general coating, that is, coating using a solid paint, for example. Meanwhile, the second shaping air directed to the outer peripheral edge of the rotary atomizing head is used for metallic coating. As such, in the coater of the Patent Literature 4, each of the first shaping air and the second shaping air is used properly, depending on the case of general coating or the case of metallic coating.

Patent Literature 5 proposes an electrostatic coater of a rotary atomization type capable of improving atomization of paint and coating efficiency and also improving the coating quality of metallic coating. The coater disclosed in Patent Literature 5 adopts a configuration in which first shaping air, second shaping air, and third shaping air are directed to the paint, in a particle state, scattered from the outer peripheral edge of the rotary atomizing head. Patent Literature 5 discloses various specific examples. One example will be described below. A coater of an embodiment includes first, second, and third air ports arranged sequentially in a radial direction from the axis of the rotary atomizing head. The first to third air ports are positioned behind the rotary atomizing head.

The first to third air ports are directed to a direction opposite to the rotation direction of the rotary atomizing head, and shaping air discharged from each air port is a jet flow in a state of being twisted in the opposite direction of the rotation direction of the rotary atomizing head. The first and the third air ports, positioned on the innermost periphery and the outermost periphery, are tilted by 30° in the circumferential direction of the rotary atomizing head. The second air ports, at an intermediate position, are tilted by 15° in the circumferential direction of the rotary atomizing head. From the first air ports positioned on the innermost periphery, first shaping air, having a high speed and a low flow rate, is discharged. From the second air ports at an intermediate position, second shaping air, having a high speed and a low flow rate, is discharged. From the third air ports positioned on the outermost periphery, third shaping air, having a high speed and a low flow rate, is discharged. By adjusting the first to third shaping air, the particle diameter of the paint particles, a coating non-volatile (NV) value, an air impact force, and the like are optimized.

Here, a coating non-volatile (NV) value is recognized as an index of evaluating the appearance quality of coating. A coating non-volatile value is defined by the following expression.

Coating *NV* value (%)=(coating film weight after drying/coating film weight at the time of coating)×100

The coating NV value is described in detail in Patent Literature 6. As such, the description thereof is omitted by incorporating Patent Literature 6 herein by reference.

CITATION LIST

Patent Literature

Patent Literature 1: Japanese Patent Laid-Open No. 7-265746 (Japanese Patent No. 3248340)

Patent Literature 2: Japanese Patent Laid-Open No. 2007-260490

Patent Literature 3: Japanese Patent Laid-Open No. 8-131902

Patent Literature 4: Japanese Patent Laid-Open No. 2000-70769

Patent Literature 5: Japanese Patent Laid-Open No. 9-94488

Patent Literature 6: Japanese Patent Laid-Open No. 2008-93533

SUMMARY OF THE INVENTION

Technical Problem

An electrostatic coater of a rotary atomization type uses a rotating atomizing head to atomize paint. The paint ejected radially outward from the atomizing head is deflected forward by shaping air, whereby a spraying pattern is formed. The spraying pattern affects the deposition efficiency of the paint particles to the workpiece.

Historically, around 1980 to 1995, attempts were made to form a spraying pattern by applying shaping air to the rear surface of a rotary atomizing head. However, the control property of the spraying pattern was inferior. In order to improve the control property of the spraying pattern, attempts were made to allow air ports, which discharge shaping air, to be placed closer to the rear surface of an atomizing head.

However, as there was no remarkable improvement effect, the invention disclosed in Patent Literature 4 proposes to apply the first shaping air to the rear surface of the rotary atomizing head and direct the second shaping air to the outer peripheral edge of the rotary atomizing head. The electrostatic coater of a rotary atomization type, proposed in Patent Literature 4, exhibits an excellent effect in the control property of the spraying pattern and atomization. A coaster based on the invention disclosed in Patent Literature 4 has established the current dominant position as a coater.

As described above, coating quality is an important factor affecting the commercial value of an automobile. Naturally, requests for improving the coating quality never stop. With the aim of achieving an electrostatic coater of a rotary atomization type capable of providing an even higher coating quality, the present inventor started the development of the electrostatic coater, and has worked out the present invention.

An object of the present invention is to provide an electrostatic coater capable of realizing high-level coating quality.

A further object of the present invention is to provide an electrostatic coater capable of improving the coating quality of metallic coating.

Solution to Problem

The inventor of the present invention reconsidered a state of paint ejected from the outer peripheral edge of a rotary atomizing head.

(1) The paint extends radially outward in a thread state from the outer peripheral edge (10*b*) of a rotating atomizing head (10). The paint in a thread state is called a "liquid thread". The liquid thread (20) extending from the atomizing head (10) is cut at the tip thereof to become a particle (22).

(2) When the rotating speed of the atomizing head (10) is relatively low (10,000 to 15,000 rpm), the liquid thread (20) extends longer. Meanwhile, as the rotating speed of the atomizing head (10) becomes faster, the liquid thread becomes shorter.

(3) When the flow rate of the paint is higher, the liquid thread (20) extends longer. Meanwhile, as the flow rate of the paint becomes lower, the liquid thread (20) becomes shorter.

(4) The paint ejected from the atomizing head (10) has large momentum in the vicinity of the outer peripheral edge (10*b*) of the atomizing head (10), due to the centrifugal force of the rotating atomizing head (10). After the liquid thread (20) of the paint is atomized, the paint is decelerated due to the friction with the air, whereby the momentum of the paint is decreased.

The present invention is characterized in that a position where the shaping air (SA) is applied is set to a position having a longer distance from the outer peripheral edge (10*b*) of the rotary atomizing head (10) than a conventional one. Specifically, the shaping air (SA) is caused to collide with the paint which is separated from the tip of a liquid thread (20) and made into a particle (22). It is more preferable that the shaping air (SA) is caused to collide with the paint particles (22) at a point where, after the paint is separated from a liquid thread (20) and made into a particle (22), the momentum of the paint particle is decreased due to air resistance.

In the present invention, a plurality of air ports are arranged concentrically with the rotational axis of the atomizing head (10), behind the outer peripheral edge (10*b*) of the rotary atomizing head (10), and shaping air (SA) is discharged radially outward from the air ports (12). After the shaping air is discharged from the air ports (12), it is secondary dispersed. Part of the secondary-dispersed shaping air forms an airflow accompanying the liquid thread (20). Thereby, an effect of extending the liquid thread (20) is expectable. Of course, by extending the liquid thread (20) by the shaping air (SA), the tip end portion of the liquid thread is narrowed. As the tip end portion of the liquid thread becomes narrower, a paint particle (22) generated by separating from the tip end of the liquid thread (20) is further micronized.

The present invention causes the shaping air (SA) to be in a state of being twisted in a direction opposite to the rotation direction of the atomizing head (10) about the rotational axis (O) thereof. This means that the shaping air (SA) discharged from the air ports (12) located behind the outer peripheral edge (10*b*) of the rotary atomizing head (10) is configured of an airflow in a state of being twisted in a direction opposite to the rotation direction of the atomizing head (10). By the shaping air (SA) in a state of being twisted in a direction opposite to the rotation direction of the atomizing head (10), an air curtain is formed. This means that an area where the shaping air (SA) collides with paint particles (22) is a position away from the outer peripheral edge (10*b*) of the atomizing head (10), which is a position having a longer distance from the air port (12) than a conventional one. As such, in the area where the shaping air (SA) collides with paint particles (22), the shaping air (SA) is in a state like a curtain with no gap, due to secondary dispersion. With the air curtain, a paint particle (22) separated from a liquid thread (20) is directed forward. As the momentum of the paint particle (22) which collides with the air curtain is relatively small, almost all quantity of the paint particles (22) generated by the atomizing head (10) can be directed forward by the shaping air. Thereby, it is possible to restrain a spraying pattern from becoming a dual pattern (restrain an outer peripheral portion of the pattern from being configured of paint of relatively large particles).

DETAILED DESCRIPTION OF THE PRESENT INVENTION

Embodiments

Figure 1:
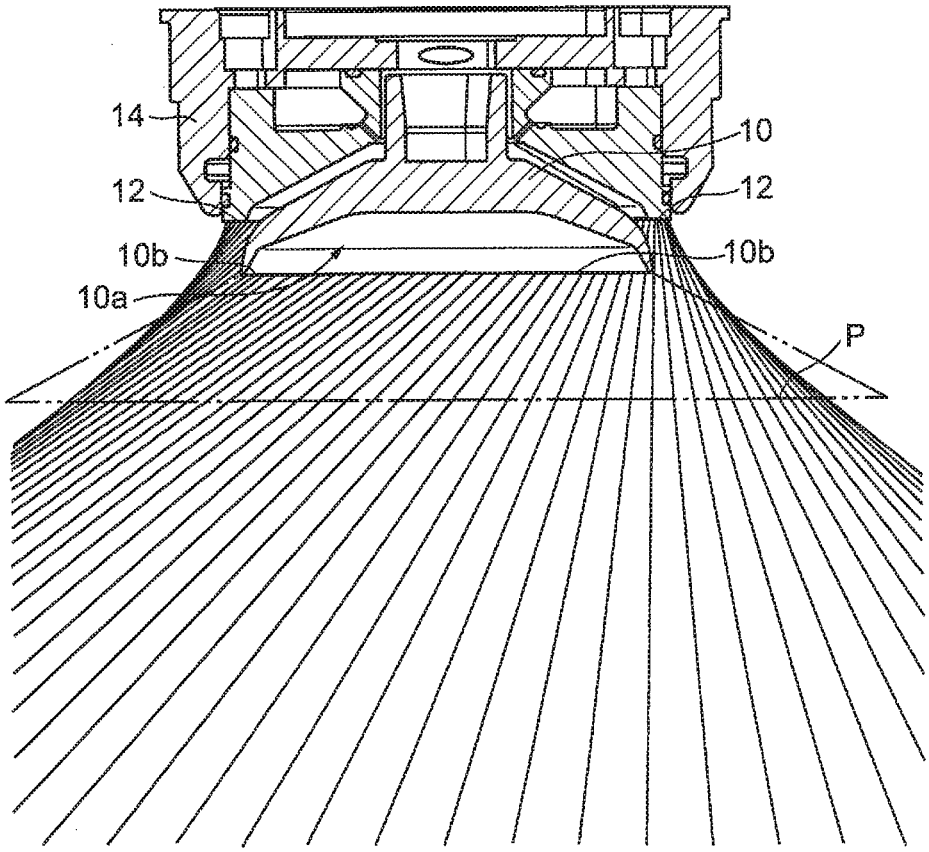
FIG. 1 is a sectional view of a tip portion of an electrostatic coater of an embodiment.
Figure 2:
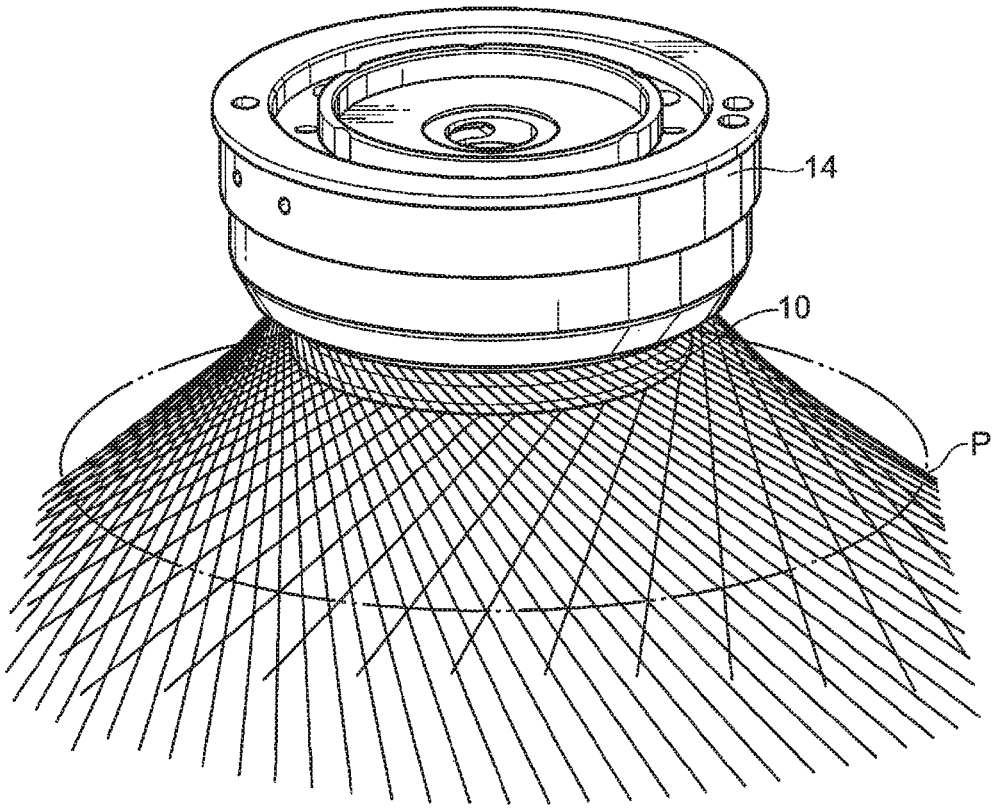
FIG. 2 is a perspective view of a shaping air ring and a rotary atomizing head constituting the tip portion of the electrostatic coater of the embodiment, when viewed from an obliquely rear side.

Hereinafter, preferred embodiments of the present invention will be described based on the accompanying drawings. FIG. 1 is a sectional view of a tip end portion of an electrostatic coater of a rotary atomization type, according to an embodiment. FIG. 2 is a perspective view when a bell cup is viewed from a shaping air ring side. Reference numeral 10 denotes a rotary atomizing head. The rotary atomizing head 10 is called a "bell cup". The bell cup 10 rotates in a single direction about the axis O thereof. The bell cup 10 has a front surface 10*a* in a recessed shape that is open toward the front. At the time of coating, paint is supplied to the center portion of the front surface 10*a* of the rotating bell cup 10. The paint extends radially outward along the recessed front surface 10*a* by the centrifugal force, and then the paint is scattered radially outward from an outer peripheral edge 10*b* of the bell cup 10. Air ports 12, which discharge shaping air SA are positioned behind the outer peripheral edge 10*b* of the bell cup 10. More specifically, the air ports 12 are formed on a front end surface of a shaping air ring 14.

Figure 3:
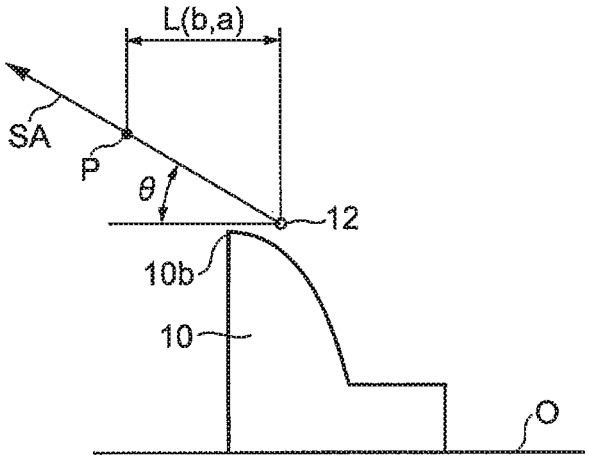
FIG. 3 is a diagram for explaining an elevation angle of shaping air discharged from an air port of the electrostatic coater of the embodiment.

Referring to FIG. 3, a plurality of air ports 12 are arranged at equal intervals on a circumference coaxial with the axis O of the bell cup 10. A configuration of forming the plurality of air ports 12 on a circumference coaxial with the axis O of the bell cup 10 has been well known, as it is understood from Patent Literatures 1 to 5. As such, the detailed description thereof is omitted. The shaping air SA discharged from the air port 12 is directed radially outward. A radially outward elevation angle θ of the shaping air SA directed radially outward, that is, an inclination angle relative to the axis O of the bell cup 10, preferably ranges from 10° to 20°.

Figure 4:
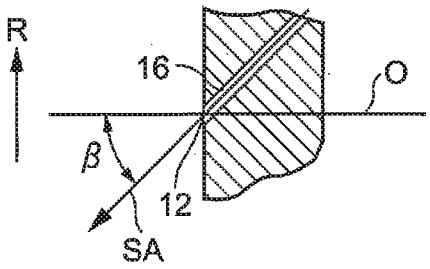
FIG. 4 is a diagram for explaining an inclination angle of the air port for generating shaping air in a state of being twisted about the axis of a bell cup.
Figure 5:
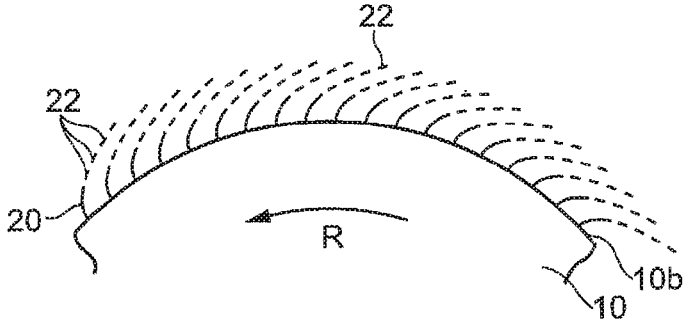
FIG. 5 is a diagram for explaining a state where paint extends radially outward in a state of a liquid thread from the outer peripheral edge of the bell cup, and is separated from the tip end of the liquid thread to become a paint particle.
Figure 6:
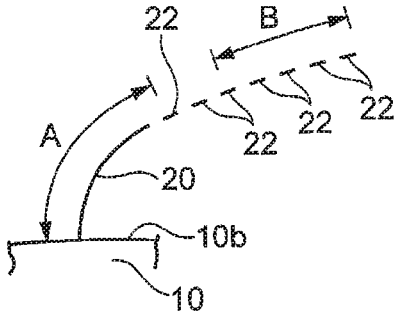
FIG. 6 is a diagram for explaining a state where paint extends radially outward in a state of a liquid thread from the outer peripheral edge of the bell cup, and is separated from the tip end of the liquid thread to become a paint particle, and also explaining a region where the paint particle is decelerated due to the friction with the air.
Figure 7:
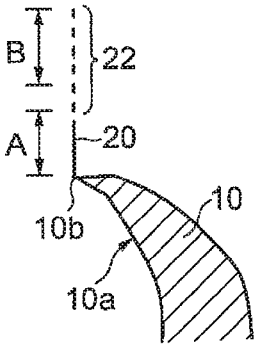
FIG. 7 is a diagram for explaining a state where paint extends radially outward in a state of a liquid thread from the outer peripheral edge of the bell cup, and is separated from the tip end of the liquid thread to become a paint particle, and also explaining a region where the paint particle is decelerated due to the friction with the air, similar to FIG. 6.

Referring to FIG. 4, the shaping air SA discharged from the air port 12 is a flow in a state of being twisted about the axis O of the bell cup 10. The twisted direction is opposite to a rotation direction R of the bell cup 10. The twisted angle β preferably ranges from 38° to 60°. Now, as the shaping air SA in a state of being twisted about the axis O of the bell cup 10 is described in detail in Patent Literatures 3 to 5, the description thereof is omitted by incorporating the entire description of Patent Literatures 3 to 5 herein by reference.

As means for causing the shaping air SA to be in a twisted state, it is acceptable to adopt a configuration of tilting a shaping 16 communicating to the air ports 12 in a direction opposite to the rotation direction R of the bell cup 10 about the axis O of the bell cup 10 (FIG. 4), or adopt an air guide arranged adjacent to the air port 12 as disclosed in Patent Literature 3.

Referring to FIGS. 5 to 8, the paint extends as a liquid thread 20 from the outer peripheral edge 10*b* of the rotating bell cup 10, and then becomes paint particles 22. In the electrostatic coater of the embodiment, the radially outward elevation angle θ of the air port 12 is set such that the shaping air SA directed radially outward is applied to the paint particles 22, rather than the liquid thread 20 (FIG. 3). As described above, it is preferable that the outward elevation θ ranges from 10° to 20°. The most preferable elevation θ is set as described below.

The paint extends out as the liquid thread 20 from the outer peripheral edge 10*b* of the rotating bell cup 10. Then, the paint 22 separate from the tip end of the liquid thread 20. The paint particles 22, separated from the liquid thread 20, fly radially outward by the centrifugal force, but starts decelerating by the friction with the air. That is, the momentum of the paint particle 22 is decreased. Reference character A in FIGS. 6 and 7 indicates a region where the momentum of the paint is relatively large by the rotating bell cup 10. Further, reference character B in FIGS. 6 and 7 indicates a region where the momentum of the paint particle 22 is decreased by the friction with the air.

In the electrostatic coater of the embodiment, the momentum of the paint 22 start decreasing at the starting point of the region B (FIGS. 6 and 7), and the momentum decreases to some extent in the vicinity of the starting point of the region B. It is preferable to set a collision point P such that the shaping air SA collides with the paint 22 at the starting point of the region B or the vicinity thereof. Of course, the shaping air SA discharged from the air port 12 is directed to the collision point P.

Figure 8:
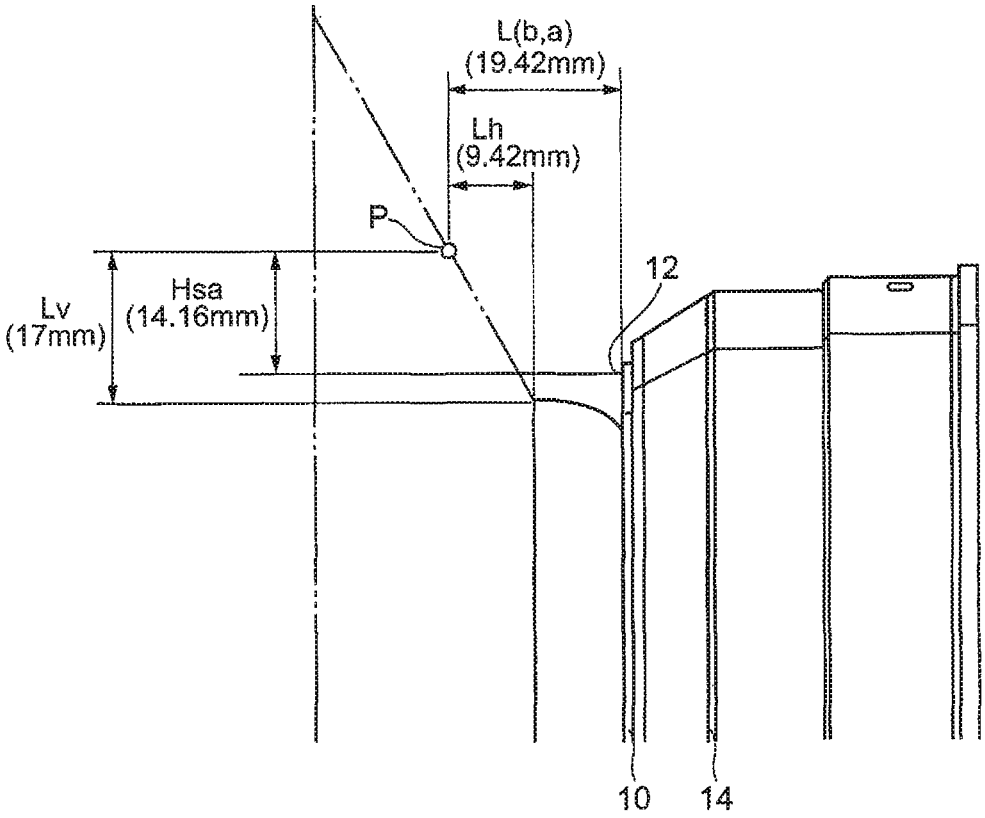
FIG. 8 is a diagram for explaining distances of respective portions included in the electrostatic coater of the embodiment.

In order to confirm the effect of the present invention, an experiment was carried out under the following conditions:

(1) Diameter of the bell cup 10: 77 mm (2) Horizontal separation distance L(b, a) between the collision point P and the air port 12: 19.42 mm (FIG. 8)

(3) Vertical separation distance Hsa between the point P where the shaping air SA collides with the paint particle 22, and the air port 12: 14.16 mm (FIG. 8)

(4) Horizontal separation distance Lh between the outer peripheral edge 10*b* of the bell cup 10 and the collision point P: 9.42 mm (FIG. 8)

(5) Vertical separation distance Lv between the outer peripheral edge 10*b* of the bell cup 10 and the collision point P: 17 mm (FIG. 8)

(6) Outward elevation θ of the shaping air SA (FIG. 3): 15°

(7) Twisted angle β of the shaping air SA (FIG. 4): 55°

(8) Pitch between adjacent air ports 12 and 12: 8.5 mm when converted into a linear distance.

Here, the diameter of the air port 12 is 0.8 mm and the number of air ports 12 is thirty (30).

It should be noted that a virtual line in FIG. 8 shows a spread of the paint scattered radially outward from the outer peripheral edge 10*b* of the bell cup 10 when there is no shaping air SA.

As a comparative example, experimental results were collected using a conventional electrostatic coater of a rotary atomization type. The coating conditions using a conventional electrostatic coater were as follows:

(1) Diameter of a bell cup: 77 mm;

(2) Horizontal separation distance L(b, a) between the outer peripheral edge of the bell cup and an air port: 11 mm;

(3) Shaping air was a flow parallel to the axis of the bell cup when viewed laterally;

(4) Shaping air was directed to a point which is 2 mm radially outward from the outer peripheral edge of the bell cup;

(5) Shaping air was a flow in a twisted state in a direction opposite to the rotation direction of the bell cup about the axis of the bell cup;

(6) Twisted angle β of the shaping air: 40°.

Metallic coating was carried out using the conventional electrostatic coater and the electrostatic coater of the embodiment. The experimental results were as shown below.

TABLE 1

| Metallic coating | | | | | |
|---|---|---|---|---|---|
| | Rotating speed of bell cup (rpm) | Paint discharge amount (cc/min.) | Flow rate of shaping air (Nl/min.) | Separation distance between workpiece and coater (mm) | Coating efficiency (%) |
| Conventional example | 40,000 | 150 | 600 | 250 | 86.10 |
| embodiment | 40,000 | 150 | 400 | 200 | 89.70 |

From the above-described experimental results, it was found that the coating efficiency of the embodiment was improved. Further, regarding the coating NV value (%), a good result was obtained that it was 33.5% in the case of using the electrostatic coater of the embodiment, while it was 25.8% in the case of using the conventional electrostatic coater. Regarding evaluation of the coating NV value (%), Patent Literature 6 should be referred to.

Figure 9:
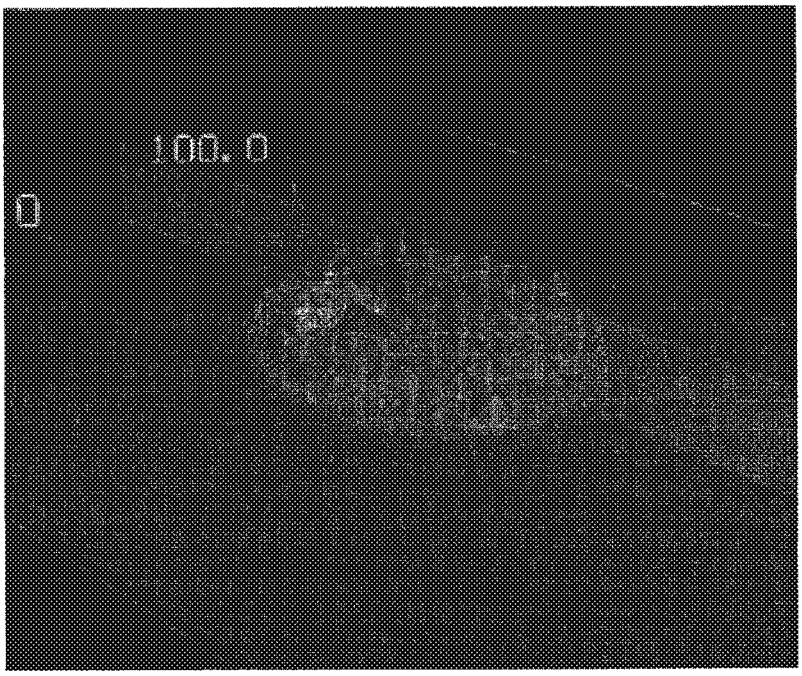
FIG. 9 is a photograph showing a state of the paint when a metallic paint is deposited on a workpiece using a conventional electrostatic coater.
Figure 10:
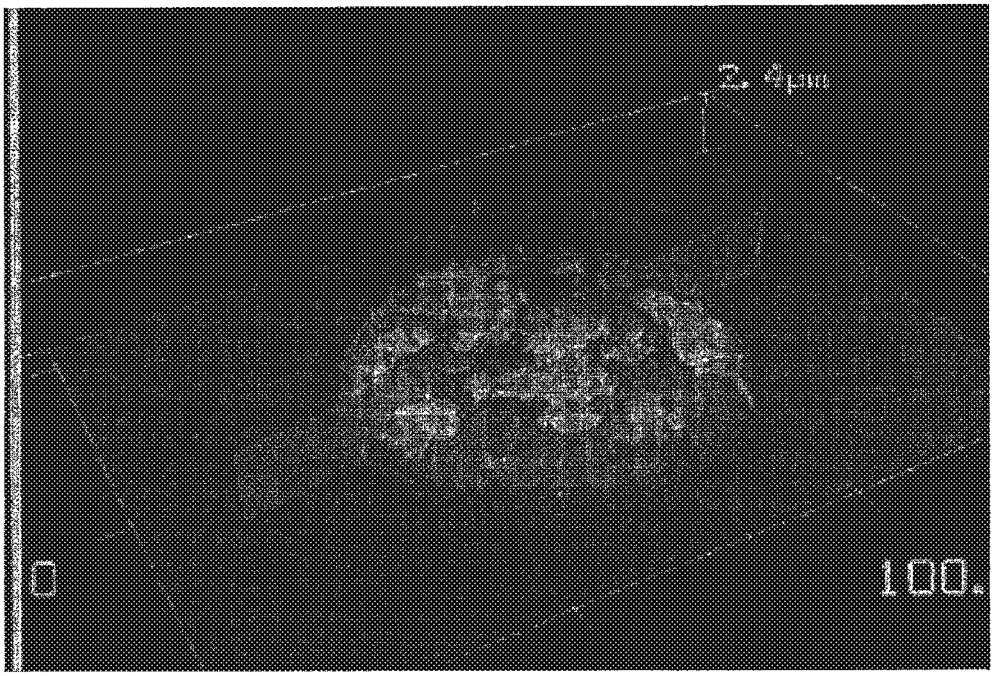
FIG. 10 is a photograph showing a state of the paint when a metallic paint is deposited on a workpiece using the electrostatic coater of an example.

FIGS. 9 and 10 are photographs of paint deposited on workpieces. FIG. 9 shows a coated surface in the case of using a conventional electrostatic coater. FIG. 10 shows a coated surface in the case of using the electrostatic coater of the embodiment. In FIGS. 9 and 10, white portions are aluminum chips. As is well understood from a comparison between FIG. 9 (conventional example) and FIG. 10 (embodiment), a larger number of aluminum chips are exposed on the coated surface in the embodiment than in the conventional example.

Figure 11:
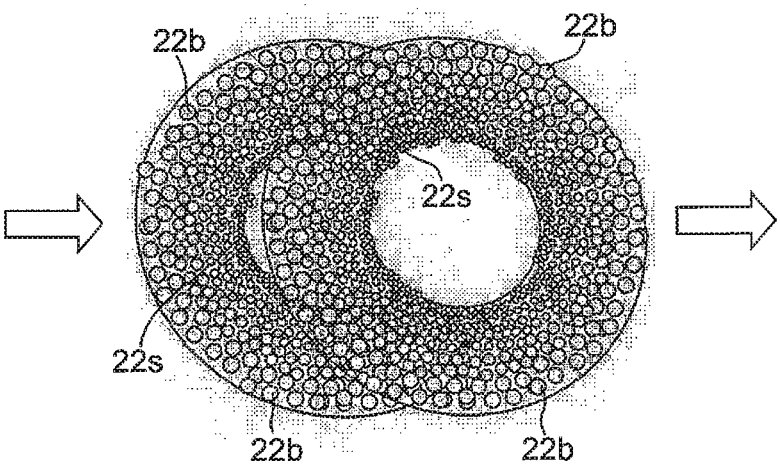
FIG. 11 is a diagram for explaining a dual pattern which is a problem in a conventional electrostatic coater.

Considering the grounds thereof, it can be said as follows when the conventional example and the embodiment are compared. FIG. 11 is a diagram for explaining a problem when the conventional electrostatic coater is used. Referring to FIG. 11, as a paint particle 22*b* having a relatively large particle diameter has large momentum, it penetrates the shaping air and jumps radially outward. Due to this phenomenon, the inner peripheral portion of the spraying pattern is configured of relatively small paint particles 22*s*, and the outer peripheral portion thereof is configured of relatively large paint particles 22*b*. As such, the spraying pattern is a dual pattern.

As is well known, coating is performed while moving the electrostatic coater. The moving direction is shown by the arrows in FIG. 11. The relatively large paint particles 22*b*, penetrating the shaping air radially outward, cover the small paint particles 22*s* deposited on the workpiece. Consequently, a large number of relatively large paint particles 22*b* are positioned on the coated surface.

As metallic chips (aluminum flakes) in the metallic paint have larger mass than that of a resin component, a collision speed of the metallic chip to the workpiece surface is relatively fast. On the workpiece surface, the surfaces around aluminum flakes are covered with the relatively large paint particles 22*b* due to the phenomenon described with reference to FIG. 11, so that the surroundings of the aluminum flakes tend to be swelled. This is also known from the photograph of FIG. 9 showing the conventional example.

Figure 12:
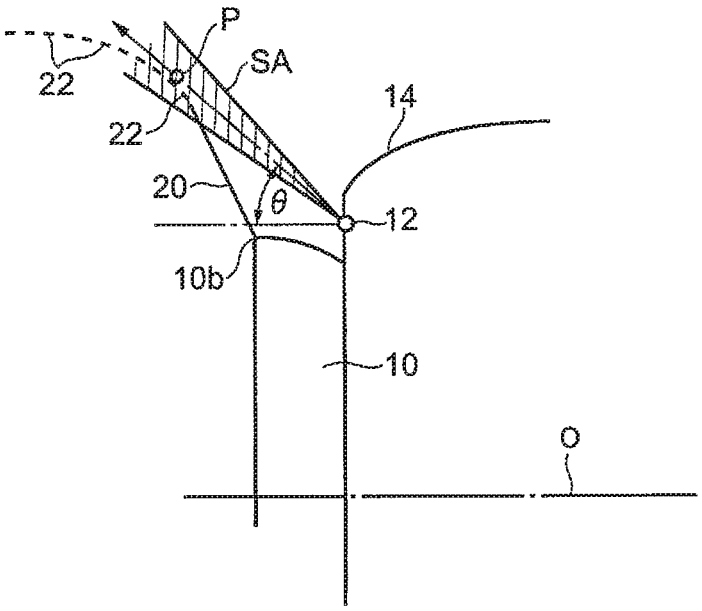
FIG. 12 is a diagram for explaining that there is a relatively large secondary dispersion region in the vicinity of a collision point where shaping air discharged radially outward from the air port collides with paint particles in the electrostatic coater of the embodiment.
Figure 13:
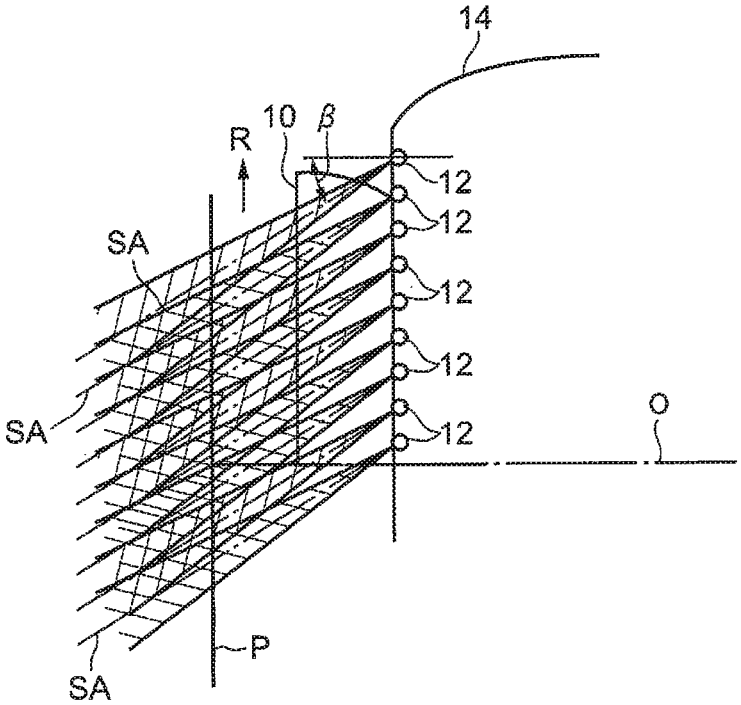
FIG. 13 is a diagram for explaining that at a collision point where shaping air collides with paint particles, the shaping air in a state of being twisted in a direction opposite to a rotation direction of a bell cup generates an air curtain continuing in a circumferential direction, in the electrostatic coater of the embodiment.

FIGS. 12 and 13 are diagrams for explaining effects of the electrostatic coater according to the present invention. With reference to FIG. 12, each of the air ports 12 is directed radially outward, and the collision point P is set in a region where the physical quantity of the paint particle 22, separated from the tip end of the liquid thread 20, is decreased. As such, a linear distance from the air port 12 to the collision point P is relatively large. Accordingly, at the collision point P, the shaping air SA discharged from the air port 12 is in a state of being dispersed radially from the axis of the shaping air SA. This means that regarding the shaping air SA discharged from the air port 12, a region of secondary dispersion thereof is relatively large in the vicinity of the collision point P. FIG. 12 shows the secondary dispersion of the shaping air SA with oblique lines.

The airflow of the secondary-dispersed shaping air SA becomes a state accompanying the liquid thread 20 extending radially outward from the outer peripheral edge 10*b* of the bell cup 10. It can be expected that the airflow of the secondary-dispersed shaping air SA acts on the liquid thread 20 extending radially outward so as to allow the liquid thread 20 to further extend radially outward. As the length of the liquid thread 20 becomes longer, the cross-sectional area of the tip end portion thereof becomes smaller. Consequently, the paint particle 22, generated by separating from the tip end of the liquid thread 20, becomes smaller. This means that further micronization of the paint is realized by the airflow of the secondary-dispersed shaping air SA.

Referring to FIG. 13, at the collision point P, the shaping air SA is in a state of being dispersed in a radial direction from the axis of the shaping air SA. As such, the collision point P is in a state where a region in which one adjacent shaping air SA is secondary dispersed and a region in which the other shaping air SA is secondary dispersed overlap with each other. This means that at the collision point P, an air curtain continuing in a circumferential direction is formed. Then, as the momentum of the paint 22 is relatively small at the collision point P, it is less likely that the paint 22 penetrate the air curtain. Thereby, it is possible to restrain a spraying pattern from becoming a dual pattern which has been a problem.

This is also clear from the photograph of FIG. 10 showing the coated surface by the embodiment. It can be said that the coated surface is in an ideal state where a large number of aluminum flakes are exposed relatively, and relatively small paint particles 22*s* fill in the gaps between the large number of aluminum flakes.

As other embodiments, modifications of the above-described embodiment were experimentally produced and tested. As a result, substantially the same effects as those of the above-described embodiment could be obtained. The specifications of the other embodiment s are as described below.

Second Embodiment (1) Diameter of the bell cup 10: 50 mm (2) Horizontal separation distance L(b, a) between the collision point P and the air port 12: 15.1 mm (3) Vertical separation distance Hsa between the point P where the shaping air SA collides with the paint particle 22, and the air port 12: 2.7 mm (4) Horizontal separation distance Lh between the outer peripheral edge 10*b* of the bell cup 10 and the collision point P: 5.1 mm (5) Vertical separation distance Lv between the outer peripheral edge 10*b* of the bell cup 10 and the collision point P: 5.6 mm (6) Outward elevation θ of the shaping air SA: 5°

(7) Twisted angle β of the shaping air SA: 45°

(8) Pitch between adjacent air ports 12 and 12: 3.8 mm when converted into a linear distance Here, the diameter of the air port 12 is 0.8 mm and the number of air ports 12 is forty five (45).

Third Embodiment (1) Diameter of the bell cup 10: 40 mm (2) Horizontal separation distance L(b, a) between the collision point P and the air port 12: 37 mm (3) Vertical separation distance Hsa between the point P where the shaping air SA collides with the paint particle 22, and the air port 12: 40.5 mm (4) Horizontal separation distance Lh between the outer peripheral edge 10*b* of the bell cup 10 and the collision point P: 26 mm (5) Vertical separation distance Lv between the outer peripheral edge 10*b* of the bell cup 10 and the collision point P: 42.2 mm (6) Outward elevation θ of the shaping air SA: 15°

(7) Twisted angle β of the shaping air SA: 55°

(8) Pitch between adjacent air ports 12 and 12: 3.8 mm when converted into a linear distance Here, the diameter of the air port 12 is 1 mm and the number of air ports 12 is thirty six (36).

Fourth Embodiment (1) Diameter of the bell cup 10: 40 mm (2) Horizontal separation distance L(b, a) between the collision point P and the air port 12: 37.3 mm (3) Vertical separation distance Hsa between the point P where the shaping air SA collides with the paint particle 22, and the air port 12: 40.7 mm (4) Horizontal separation distance Lh between the outer peripheral edge 10*b* of the bell cup 10 and the collision point P: 26.3 mm (5) Vertical separation distance Lv between the outer peripheral edge 10*b* of the bell cup 10 and the collision point P: 42.7 mm (6) Outward elevation θ of the shaping air SA: 15°

(7) Twisted angle β of the shaping air SA: 55°

(8) Pitch between adjacent air ports 12 and 12: 3.8 mm when converted into a linear distance Here, the diameter of the air port 12 is 1 mm and the number of air ports 12 is thirty six (36).

Fifth Embodiment (1) Diameter of the bell cup 10: 40 mm (2) Horizontal separation distance L(b, a) between the collision point P and the air port 12: 37.6 mm (3) Vertical separation distance Hsa between the point P where the shaping air SA collides with the paint particle 22, and the air port 12: 40.7 mm (4) Horizontal separation distance Lh between the outer peripheral edge 10*b* of the bell cup 10 and the collision point P: 26.6 mm (5) Vertical separation distance Lv between the outer peripheral edge 10*b* of the bell cup 10 and the collision point P: 43.2 mm (6) Outward elevation θ of the shaping air SA: 15°

(7) Twisted angle β of the shaping air SA: 55°

(8) Pitch between adjacent air ports 12 and 12: 3.9 mm when converted into a linear distance Here, the diameter of the air port 12 is 1 mm and the number of air ports 12 is thirty six (36).

REFERENCE SIGNS LIST

10 Rotary atomizing head included in coater of embodiment (bell cup)
O Axis of bell cup
10*a* Recessed front surface of bell cup
10*b* Outer peripheral edge of bell cup
12 Air port which discharges shaping air
SA Shaping air
θ Radially outward elevation angle of shaping air
β Twisted angle of shaping air
P Point where shaping air collides with paint particles
L(b, a) Horizontal separation distance (between collision point P and air port)
Hsa Vertical separation distance between air port and collision point
Lh Horizontal separation distance between outer peripheral edge of bell cup and collision point
Lv Vertical separation distance between outer peripheral edge of bell cup and collision point
20 Liquid thread of paint
22 Paint particle

What is claimed is:

1. An electrostatic coater comprising:

a rotary atomizing head configured to rotate in a first direction and scatter paint radially outward to atomize the paint; and air ports positioned behind an outer peripheral edge of the rotary atomizing head, the air ports being configured to discharge shaping air to a front, wherein the air ports consist of only a plurality of air ports arranged at equal intervals on a single circumference coaxial with a rotational center axis of the rotary atomizing head;

wherein the air ports direct the shaping air radially outward, the shaping air is directed such that part of secondary-dispersed air of the shaping air becomes air accompanying a liquid thread of paint extending from the rotary atomizing head, and that the shaping air collides with a paint particle separated from the liquid thread of the paint extending radially outward from the rotary atomizing head;

wherein the shaping air collides with the paint particle at a point apart radially outward from a tip end of the liquid thread of paint;

wherein the shaping air collides with the paint particle at a vertical separation distance between 5.6 mm and 43.2 mm from the outer peripheral edge of the rotary atomizing head;

wherein the shaping air discharged from the air ports is twisted in a second direction opposite the first direction of the rotary atomizing head.

2. The electrostatic coater according to claim 1, wherein an elevation angle of the shaping air directed radially outward ranges from 10 to 20 degrees, and wherein the elevation angle is configured to direct the shaping air to collide with the paint particle after the paint particle separates from a liquid thread of paint.

3. The electrostatic coater according to claim 2, wherein a twisted angle of the shaping air about the rotational center axis of the rotary atomizing head ranges from 38 to 60 degrees.

4. The electrostatic coater according to claim 1, wherein the electrostatic coater is applicable to metallic coating.

5. The electrostatic coater according to claim 1, wherein the shaping air from neighboring air ports is configured to overlap while spraying.

* * * * *